US005413025A

United States Patent [19]

Martin

[11] Patent Number: 5,413,025

[45] Date of Patent: May 9, 1995

[54] ELECTRO-THERMAL GATLING GUN

[75] Inventor: Scott G. Martin, Alta Loma, Calif.

[73] Assignee: Hughes Missile Systems Company, Los Angeles, Calif.

[21] Appl. No.: 81,894

[22] Filed: Jun. 25, 1993

[51] Int. Cl.[6] ..... F41A 19/68

[52] U.S. Cl. ..... 89/8; 89/12; 89/135

[58] Field of Search ..... 89/8, 12, 13.05, 28.05, 89/135

[56] References Cited

U.S. PATENT DOCUMENTS

| | | | |
|---|---|---|---|
| 2,849,921 | 9/1958 | Otto | 89/12 |
| 3,854,231 | 12/1974 | Broyles | 42/84 |
| 4,895,062 | 1/1990 | Chryssomallis et al. | 89/7 |
| 4,974,487 | 12/1990 | Goldstein et al. | 89/7 |
| 5,218,161 | 6/1993 | Martin | 89/8 |
| 5,233,902 | 8/1993 | Bernardes | 89/8 |

OTHER PUBLICATIONS

*Military Technology*, pp. 81,82,83,85 and 86 (May 1988).

*National Defense*. pp. 20–23 (Sep. 1990).

*Primary Examiner*—Stephen C. Bentley

*Attorney, Agent, or Firm*—Charles D. Brown; Randall M. Heald; Wanda K. Denson-Low

[57] ABSTRACT

An electro-thermal gatling gun (12) includes a plurality of gun barrels (46) and a gun rotor (10) defining a plurality of channels (30). Each channel (30) guides a breechblock (32) between a rear position (50) and a breech position (52). Each said guide channel (30) is aligned with and rotatably fixed to one of the plurality of gun barrels (46). A cam guide (49) moves the breechblocks (32) reciprocally and in series from the rear position (50) to the breech position (52) as the gun rotor (10) rotates. An electro-thermal round (60) includes a projectile (62) and a casing (64) and is electrically connected to one of the breechblocks (32) when the breechblock (32) is in the breech position (52). A rotating electrical mechanism (16) provides an electrical connection between a high power electrical cable (22) and said one of said breechblocks (32) when said one of said breechblocks (32) is in said breech position (52) and maintains the electrical connection during gun rotation and until the projectile (62) exits the gun barrel (46).

14 Claims, 5 Drawing Sheets

ELECTRO-THERMAL GATLING GUN

BACKGROUND OF THE INVENTION

1. Field of the Invention

The present invention relates to weapon systems, and more particularly, to a gatling gun utilizing electro-thermal rounds.

2. Description of Related Art

Gatling guns may be used to propel a stream of projectiles at a designated target. The aerodynamic properties and muzzle velocities of the stream of projectiles fired from the gatling gun are typically the same. The projectiles arrive at a given target with the same linear spacing and in the order in which they are fired. Target damage occurs as the individual projectiles impact the target.

It is known that target damage increases if projectiles hit a target simultaneously as compared to the same number of projectiles impacting individually. Target damage also increases as the speed of the projectiles at impact increases.

Electro-thermal gun technology involves using electrical energy to create a plasma which acts on a working fluid to generate a light gas behind a projectile. The light gas has the advantage, over conventional powder propellants, of having a lower molecular weight and a higher speed of sound capability similar to the effects produced in light gas guns.

Muzzle velocity of the electro-thermal guns can be varied through control of the electrical energy input of the gun. The plasma created varies as the electrical input varies. Thus at any point during the projectile's travel down the barrel, the pressure behind the projectile can be maximized (equal to the yield strength of the barrel). By contrast, conventional propellant guns build up a high initial pressure that decays as the projectile moves down the barrel.

Using electro-thermal technology, muzzle velocity can be varied to achieve simultaneous impact from successively fired projectiles as described in my application Ser. No. 07/695,846, entitled "Projectile Wall Barrage System", filed May 6, 1991, now U.S. Pat. No. 5,218,161, which is hereby incorporated by reference. Projectile weight can also be increased while maintaining the same muzzle velocity as conventional propellant guns. Alternatively, muzzle velocity can be increased while maintaining the same projectile weight.

Several problems are encountered when applying the electro-thermal gun technology to multi-barrel gatling guns. The barrels of the gatling gun rotate and only one barrel can be fired at a time. Gatling guns typically use 20–30 mm projectiles or larger and encounter gun recoil.

As described above, the electrical input must be applied to the plasma throughout the projectile travel down the barrel. It is also desirable to have a single voltage source associated with one multi-barrel gatling gun.

SUMMARY OF THE INVENTION

The invention is directed to an electro-thermal gatling gun including a plurality of gun barrels and a gun rotor defining a plurality of channels. Each channel guides a breechblock between a rear position and a breech position. Each said guide channel is aligned with and rotatably fixed to one of the plurality of gun barrels. A cam guide moves the breechblocks reciprocally and in series from the rear position to the breech position as the gun rotor rotates.

An electro-thermal round includes a projectile and a casing and is electrically connected to one of the breechblocks when the breechblock is in the breech position. A rotating electrical mechanism provides an electrical connection between a high power electrical cable and said one of said breechblocks when said one of said breechblocks is in said breech position and maintains the electrical connection during gun rotation and until the projectile exits the gun barrel.

It is a feature of the invention that the rotating electrical mechanism includes a stator connected to said high power electrical cable, a rotor contact fixed for rotation with said gun rotor, and a brush contact means for electrically connecting said rotor contact and said stator as said rotor rotates. The rotor contact connects said stator to said one of said breechblocks in said breech position.

It is a further feature of the invention that the stator, the brush contact, and the rotor contact are insulated from the gun rotor.

It is a further feature of the invention that the breechblocks include an insulated electrical contact which provides an electrical connection between the rotor contact and said one of said breechblocks when said one of said breechblocks is in said breech position.

Another feature of the invention is that the insulated electrical contact is L-shaped.

Other objects, features and advantages will be readily apparent.

DESCRIPTION OF THE PREFERRED EMBODIMENTS

Figure 1:
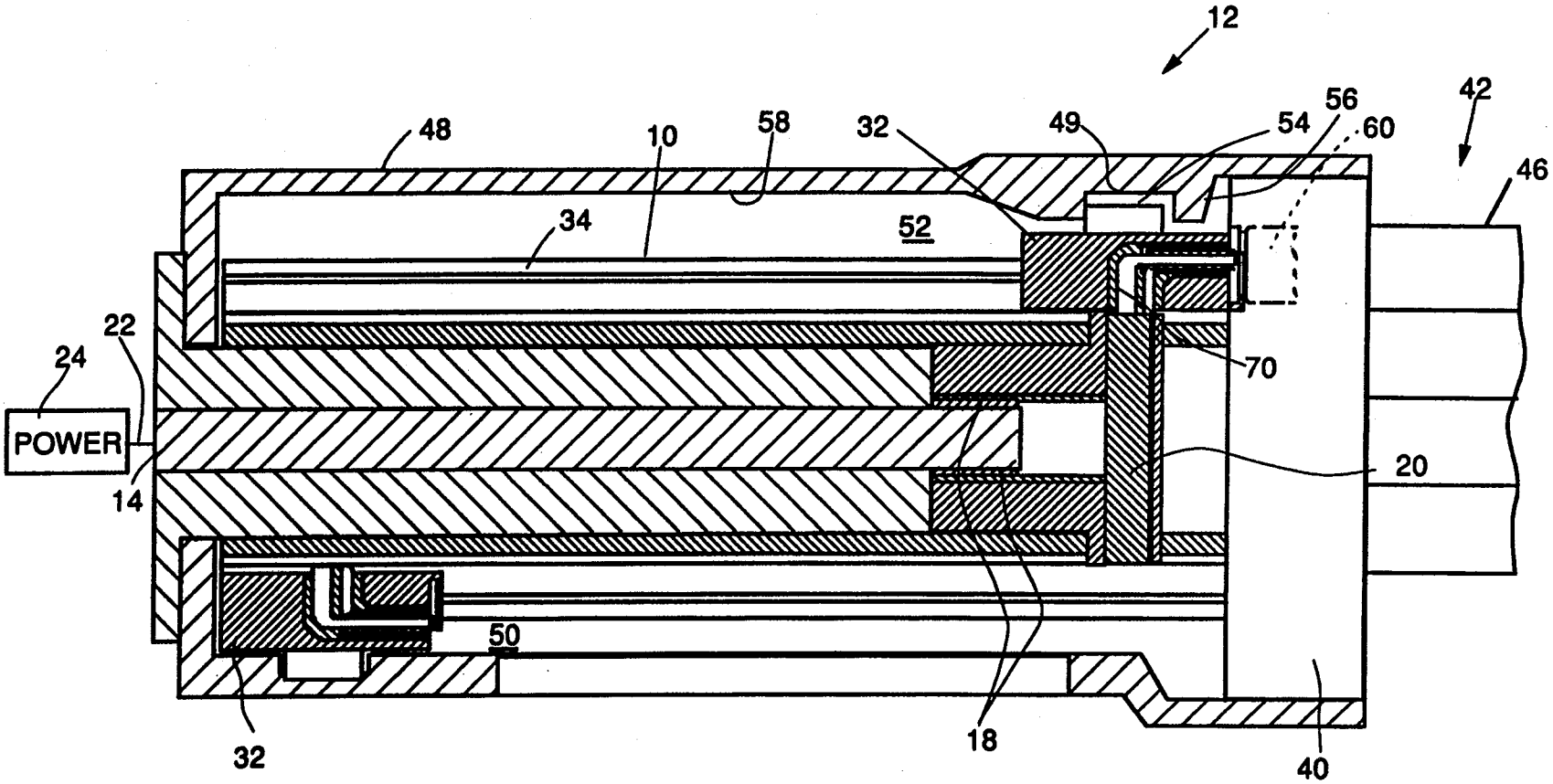
FIG. 1 is a cross-sectional view of a gun rotor and breechblocks for an electro-thermal gatling gun according to the invention.

In FIG. 1, a cross-sectional view of a gun rotor 10 for an electro-thermal gatling gun 12 according to the present invention is shown. The gun rotor 10 rotates about a stationary central axis of stator 14. A rotating electrical mechanism 16 is provided by the stator 14, brush contacts 18 and rotor contact 20. The brush contacts 18 connect the stator 14 to the rotor contact 20 which can rotate with respect to the stator 14. The stator 14 is connected to a high power electrical cable 22 and power supply 24 as will be described below.

Figures 2A, 2B, 7C:
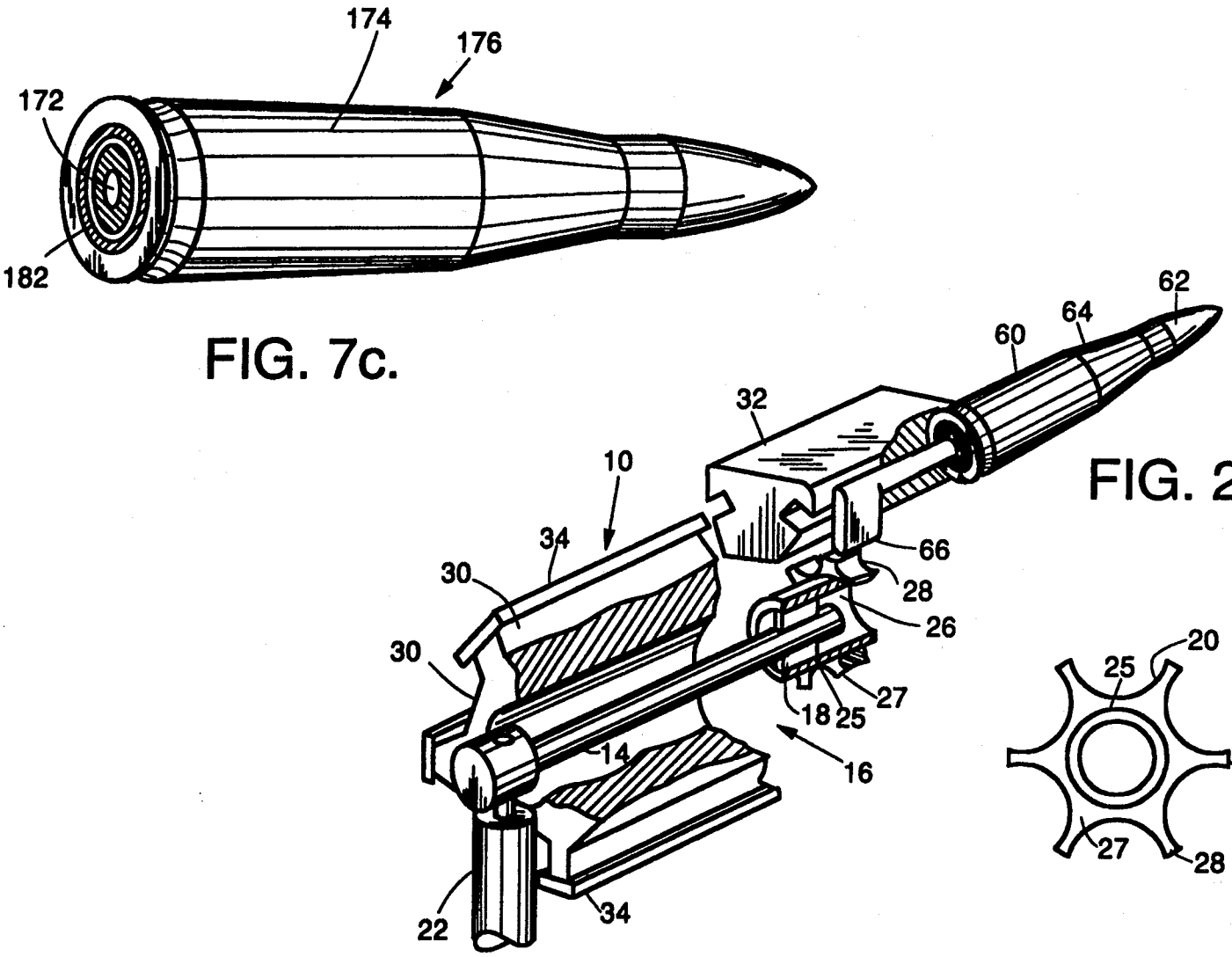
FIG. 2*a* is a perspective sectional view of the gun rotor, the breechblock and electro-thermal round of the gatling gun according to the present invention.
FIG. 2*b* is a plan view of the rotor contact.
FIG. 7*c* is a perspective view of an electro-thermal round showing contact surfaces for the alternate embodiment of FIG. 4.
Figure 3C:
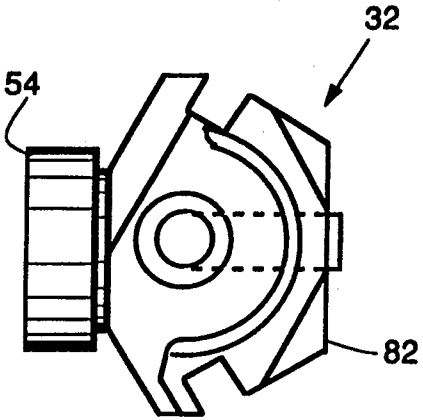
FIG. 3*c* is a front view of the breechblock.
Figure 3B:
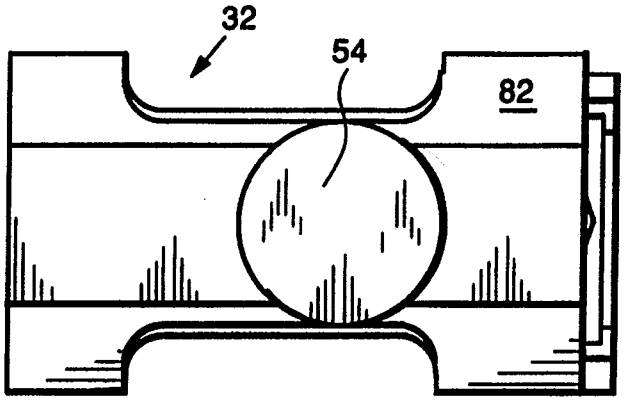
FIG. 3*b* is a plan view of the breechblock.
Figure 3D:
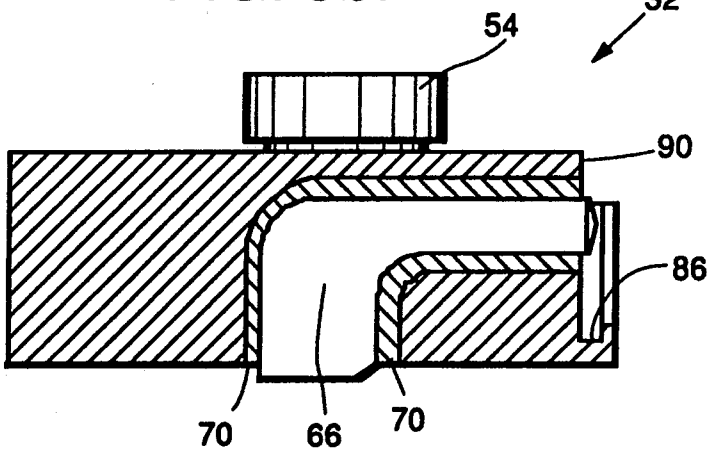
FIG. 3*d* is a side cross-sectional view of the breechblock.
Figure 3A:
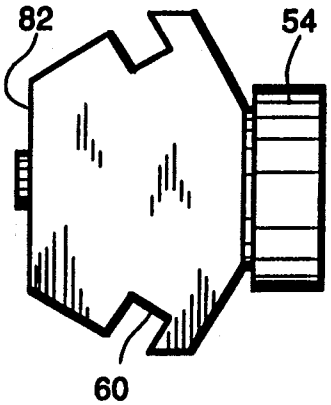
FIG. 3*a* is rear view of the breechblock.

In FIG. 2*a*, a perspective sectional view of the gatling gun of FIG. 1 is shown. The rotor contact 20 includes a cylinder 25 having the brush contacts mounted on an inner surface 26 thereof. A star-shaped portion 27 is attached to an end of the cylinder 25 and includes a plurality of projections 28.

The gun rotor 10 defines a plurality of guide channels 30 which slidingly receive a plurality of breechblocks 32. Guide plates 34 maintain the breechblocks 32 in the guide channels 30. A cylindrical bearing and casing 40 (FIG. 1) encloses an end of an assembly 42 including a plurality of gun barrels 46 mounted together symmetrically about the axis of the stator 14. The gun barrel assembly 42 is fixed for rotation with the gun rotor 10 and the rotor contact 20. Breech ends of the barrels 46 are aligned with the guide channels 30 and are enclosed by the cylindrical bearing and casing 40. The rotor contact 20 includes one projection 28 per barrel 46.

A housing 48 encloses the gun rotor 10 when assembled. During use, a cam guide 49 located between the gun rotor 10 and the housing 48 sequentially and reciprocally moves the breechblocks 32 in the guide channels 30 from a rear position at 50 to a breech position at 52 as the gun rotor 10 rotates.

The breechblocks can include a cam follower 54 which is slidingly received in the cam guide 49. The cam guide 49 can be an elliptical groove 56 formed on an inner surface 58 of the housing 48. Alternatively, the cam guide 49 can be manufactured separately, for example the main U-shaped cam 36 which is received inside the two-piece housing 9, 11 in FIG. 7 of U.S. Pat. No. 2,849,921 to Otto, which is incorporated by reference. Other cam guide designs 49 are contemplated.

A cartridge stripping and feeding mechanism is mounted on the housing 48 for the gun rotor 10 and positions electro-thermal rounds 60 in the guide channel 30 between the breechblock 32 and the associated gun barrel (FIG. 2). The electro-thermal rounds 60 include a projectile 62 and a casing 64. One cartridge and stripping means is shown in FIGS. 11 and 13 of the aforementioned U.S. Pat. No. 2,849,921.

Each breechblock 32 houses an electrical contactor 66 which can be L-shaped as shown in FIG. 1. Other shaped electrical contactors are contemplated. Insulation 70 surrounds and isolates the electrical contactor 66 from the body of the breechblock 32.

As the cam guide 49 moves the breechblocks 32 from the rear position 50 to the breech position 52, the electro-thermal rounds 60 are positioned in front of the breechblocks 32. Upon reaching the breech position 52, the breechblock 32 provides an electrical connection from the stator 14 through the brush and rotor contacts 18, 20, respectively, to the L-shaped electrical contactor 66 in the breechblock 32. The L-shaped electrical contactor 66 abuts the electro-thermal round 34 (FIG. 2).

Since the stator 14, the brush contact 18, the rotor contact 20, and the electrical contactor 66 are insulated and the electro-thermal round 60 is in contact with non-insulated parts of the electro-thermal gatling gun 10 including the gun rotor 10, the electrical connection is completed through the electro-thermal round 60 and the non-insulated parts of the electro-thermal gatling gun 12.

Muzzle velocity of electro-thermal ammunition is controlled by electrical energy input thereto. Electro-thermal gun systems are described in Military Technology, pp. 81, 82, 83, 85 and 86 (May 1988); in National Defense, pp. 20–23 (September 1990); in U.S. Pat. No. 4,895,062 to Chryssomalis et al; and in U.S. Pat. No. 4,974,487 to Goldstein et al, all incorporated herein by reference.

Generally, the electrical energy input to the electro-thermal ammunition acts on a working fluid located behind the projectile 62 to create a light gas. The light gas has a lower molecular weight and a higher speed of sound capability than conventional powder propellants. Additional energy can be imparted to the projectile 62 by adding chemical energy input to the electrical energy input.

The amount of light gas created behind the projectile 62 varies as the electrical energy input varies. Thus the electrical energy input can be tailored to maintain a maximum pressure, just below the yield strength of the barrel, behind the projectile 62 as it travels down the barrel. By contrast, conventional propellant guns build up a high initial pressure which decays as the projectile 62 moves down the barrel.

As can be appreciated, by maximizing the pressure behind the projectile 62 for the entire length of the barrel, the muzzle energy of the electro-thermal gatling gun can be doubled. Since kinetic energy equals one half mass times velocity squared, either the launch mass may be doubled or the velocity increased by 40%.

Additionally, by shaping the electrical energy input to a group of electro-thermal rounds 60, for example 6 rounds for a 6 barrel gatling gun, the projectiles 62 may be fired to arrive at a predetermined target range simultaneously, as described in my previously identified copending application entitled "Projectile Wall Barrage System".

The rotating electrical mechanism 16 provided by the stator 14, the brush contacts 18, and the rotor contact 20 allows the gun barrel assembly 42 to rotate while the projectile 62 proceeds down the barrel 46. The rotating electrical mechanism 16 maintains a closed electrical circuit to allow electrical energy input from the power supply 24 to tailor the pressure of the propelling light gas behind the projectile 62 while the projectile 62 remains in the barrel 46. As known in the art, this can be accomplished by appropriately shaping the electrical pulse from supply 24.

After the projectile 62 exits the barrel 46, the gun rotor 10 has rotated and the cam guide 49 moves the breechblock 32 in the guide channel 30 towards the rear position 50 breaking electrical contact between the rotor contact projection 28 and L-shaped contactor 66. Before reaching the rear position 50, the casing 64 for the spent electro-thermal round 60 is removed in the normal manner through an opening (not shown) in the housing 48.

As can be appreciated, contact between the insulated stator 14, brush contacts 18 and rotor contacts 20 and the non-insulated parts of the electro-thermal gatling gun 12 can be accomplished only when the breechblocks 32 are fully in the breech position 52. Since the cam guide 49 positions only one breechblock 32 at a time in the breech position 52, only one electro-thermal round 60 can be fired at a time.

In FIGS. 3A–3D, the breechblock 32 is shown in greater detail. The guide plates 34 are received in longitudinal slots 61 on the breechblock 32. The cam guide 49 engages the cam follower 54 located on a top surface 82 of the breechblock 32 to move the breechblock 32 reciprocally between the breech position 52 and the rear position 50. The breechblock 32 includes a slotted portion 86 on a forward surface 90 thereof which engages the casing 64 of the electro-thermal round 60 when inserted therein.

After firing, the casing 64 of the electro-thermal round 60 is held by the slotted portion 86 while the breechblock 32 is moved towards the rear position 50. Prior to the breechblock 32 reaching the rear position 50, the casing 64 is removed. An unspent electro-thermal round 60 is loaded into the slotted portion 86 after the breechblock 32 reaches the rear position 50 and begins moving towards the breech position 52.

Figure 4:
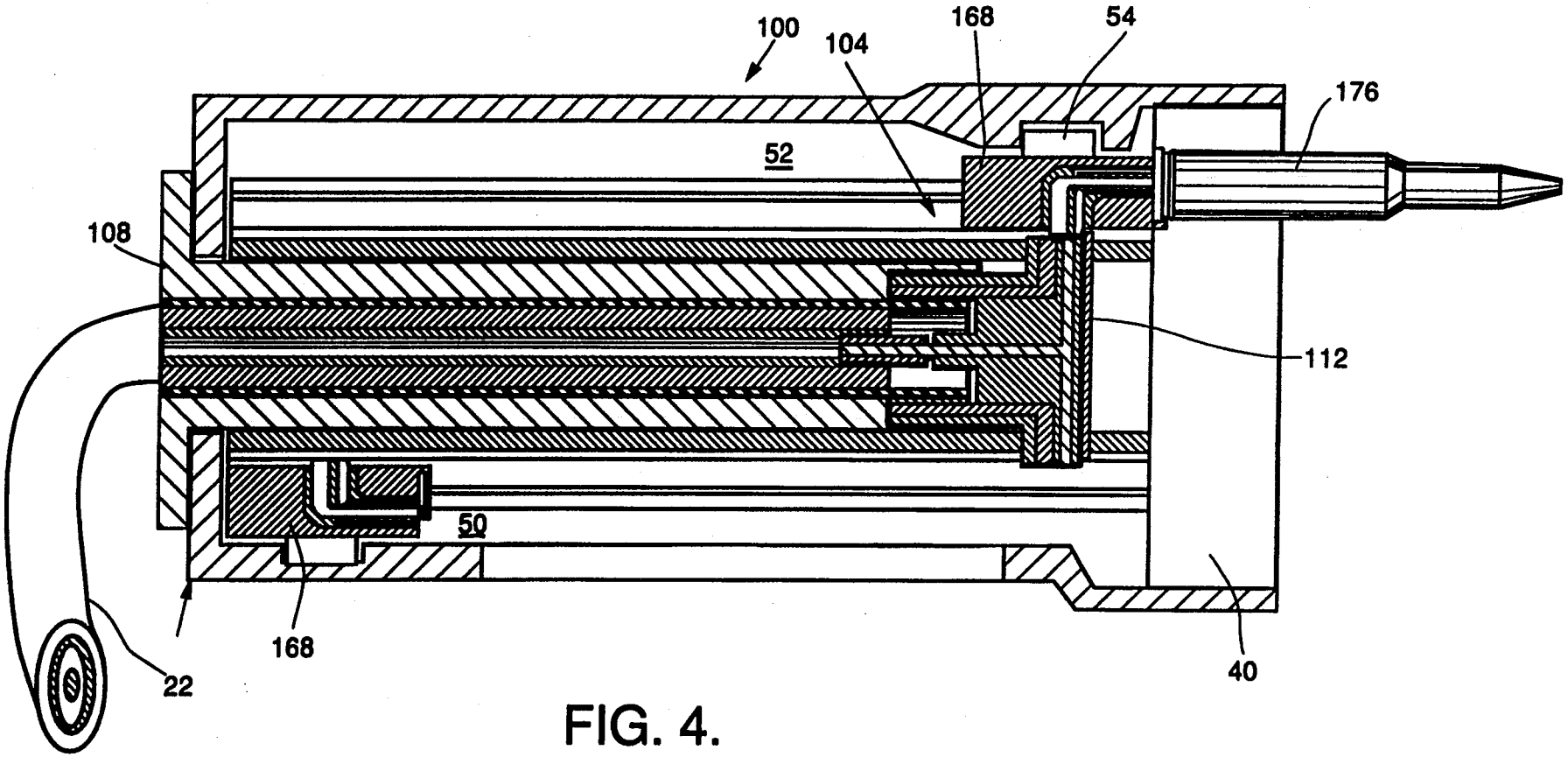
FIG. 4 is a cross-sectional view of a two-wire electro-thermal gatling gun according to an alternate embodiment of the invention.

In FIG. 4, a two-wire electro-thermal gatling gun 100 according to an alternate embodiment of the invention is shown. Operation of the two-wire electro-thermal gatling gun 100 is essentially the same as the electro-thermal gatling gun 12 of FIGS. 1–3. The differences in operation are described below in detail.

Figure 5:
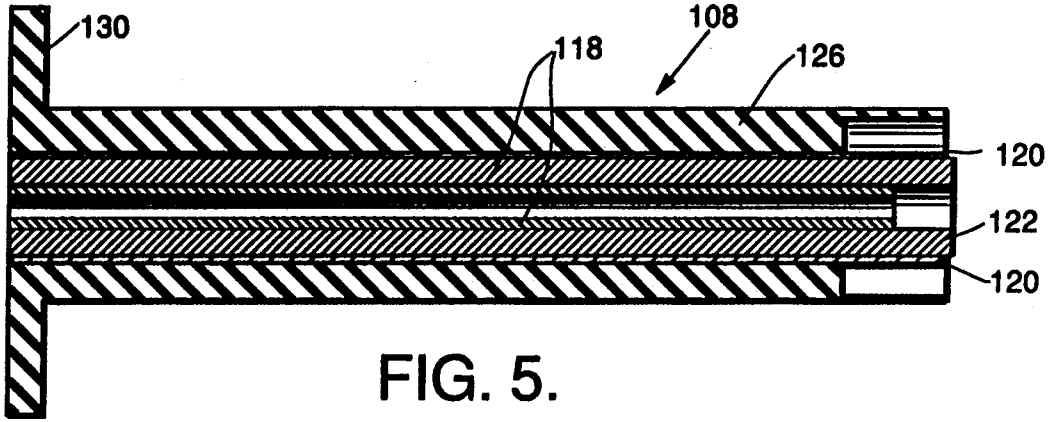
FIG. 5 is a cross-sectional view of a stator for the alternate embodiment of FIG. 4.

The gatling gun 100 includes a rotating electrical mechanism 104 including a stator 108, and a rotor contact 112. Referring to FIG. 5, the stator 108 includes inner and outer cylindrical conductors 118,120 with insulation 122 sandwiched therebetween. An outer cylindrical insulator 126 surrounds an outer surface of the outer conductor 120. An annular radial projection 130 extends from an end of the stator 108 to provide for attachment to the housing 48, adjacent the high power electrical cable 22, to prevent rotation of the stator.

Figure 6A:
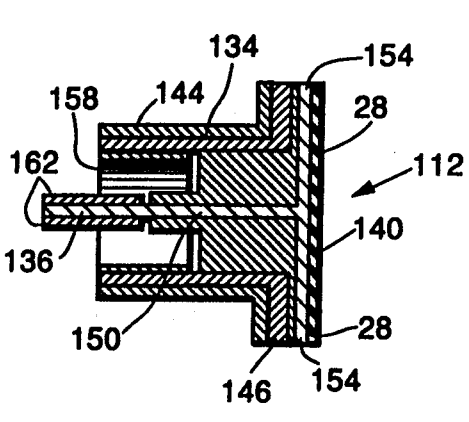
FIG. 6*a* is a cross-sectional view of a rotor contact for the alternate embodiment of FIG. 4.
Figure 6B:
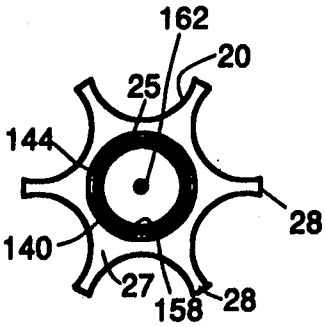
FIG. 6*b* is a plan view of the rotor contact of FIG. 6*a;*

In FIG. 6*a* a cross-section of the rotor contact 112 for the electro-thermal gatling gun 100 is shown. The rotor contact 112 includes the star-shaped portion 27 with the projections 28, as best seen in FIG. 6B, and first and second conductors 134, 136 surrounded and separated by insulation 140.

The first conductor 134 includes a cylindrical portion 144 having a plurality of legs 146, one leg 146 extending into each of the projections 28. The second conductor 136 includes a center portion 150 attached to a plurality of legs 154, one leg 154 extending into each projection 28.

A first cylindrical brush contact 158 is attached to the inner surface of the cylindrical portion 144 of the first conductor 134. A second cylindrical brush contact 162 encloses an end of the center portion 150 of the second conductor 136.

Figure 7B:
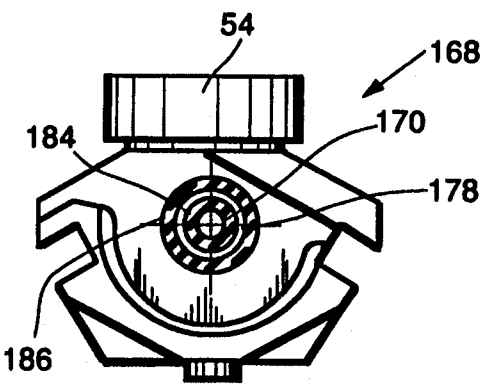
FIG. 7*b* is a front view of the breechblock for the alternate embodiment of FIG. 4.
Figure 7A:
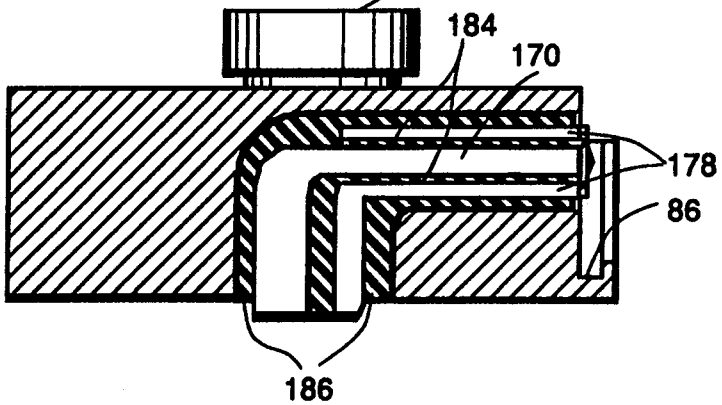
FIG. 7*a* is a cross-sectional view of a breechblock for the alternate embodiment of FIG. 4.

In FIG. 7, a breechblock 168 for the electro-thermal gatling gun 100 is shown. The breechblock 168 includes first L-shaped conductor 170 which connects the first conductor 134 to the center conductor 172 on a casing 174 of an electro-thermal round 176. A second L-shaped/circular conductor 178 connects the second conductor 136 to a second circular conductor 182 on the casing 174 of the electro-thermal round 176. The first and second L-shaped conductors 170, 178 are separated by an insulator 184 and are surrounded by an insulator 186.

The rotor contact 112 is fixed to the gun rotor 10 and both rotate with respect to the stator 108 in use. The brush contacts 158, 162 maintain electrical connection between the stator 108 and the rotor 112.

When the cam guide 49 moves the breechblock 168 into the breech position 52, an electrical circuit is completed in the following manner: the outer cylindrical conductor 120 is connected to the high power cable 22; the brush contact 158 connects the outer cylindrical conductor 120 to the first conductor 134; the first L-shaped conductor 170 connects the first conductor 134 to the center conductor 172 of the electro-thermal round 176; the second circular conductor 182 of the electro-thermal round 176 is connected to the second L-shaped/circular conductor 178; the second L-shaped/circular conductor 178 is connected to the second conductor 136; and the brush contact 162 connects the second conductor 136 to the inner cylindrical conductor 118 which is connected to the high power cable 22. A controlled electrical input can then be applied to the electro-thermal round 176.

Accordingly, an electro-thermal gatling gun according to the improvement of this invention has been disclosed. While several aspects and embodiments have been shown and described, it should be understood that modifications and adaptations thereof will occur to those skilled in the art. Further details of gatling guns in general may be found in U.S. Pat. No. 2,849,921 to Otto, which is hereby incorporated by reference.

What is claimed is:

1. An electro-thermal gatling gun for firing an electro-thermal round, comprising:

a plurality of gun barrels;

a gun rotor defining a plurality of channel means each for guiding a breechblock between a rear position and a breech position, each said guide channel means being aligned with and rotatably fixed to one of said plurality of gun barrels;

cam guide means for moving said breechblocks reciprocally and in series from said rear position to said breech position as said gun rotor rotates; and rotating electrical means for providing an electrical connection between a high power electrical cable and said one of said breechblocks when said one of said breechblocks is in said breech position and for maintaining said electrical connection during gun rotation said rotating electrical means comprising:

a stator connected to said high power electrical cable;

a rotor contact fixed for rotation with said gun rotor; and a brush contact means for electrically connecting said rotor contact and said stator as said rotor rotates, wherein said rotor contact connects said stator to said one of said breechblocks in said breech position.

2. The electro-thermal gatling gun of claim 1 wherein said stator, said brush contact, and said rotor contact are insulated from said gun rotor.

3. The electro-thermal gatling gun of claim 2 wherein said breechblocks include an insulated electrical contact means for providing an electrical connection between the rotor contact and said one of said breechblocks when said one of said breechblocks is in said breech position.

4. The electro-thermal gatling gun of claim 3 wherein said insulated electrical contact means is L-shaped.

5. The electro-thermal gatling gun of claim 4 wherein said breechblock includes a means for engaging the electro-thermal round.

6. The electro-thermal gatling gun of claim 5 wherein said engaging means includes a slotted portion on a forward surface of the breechblock.

7. The electro-thermal gatling gun of claim 6 wherein said channel means includes guide plates and said breechblocks include longitudinal slots for slidingly receiving said guide plates.

8. The electro-thermal gatling gun of claim 2 wherein said rotor contact includes a cylindrical portion attached to a star-shaped portion having one projection for each barrel.

9. The electro-thermal gatling gun of claim 2 wherein said stator includes inner and outer cylindrical conductors insulated from each other.

10. The electro-thermal gatling gun of claim 9 wherein said brush contact means includes first and second cylindrical brush contacts.

11. The electro-thermal gatling gun of claim 10 wherein said rotor contact includes:

a first conductor connected to said outer cylindrical conductor by said first cylindrical brush contact; and a second conductor connected to said inner cylindrical conductor by said second cylindrical brush contact, wherein said first conductor is insulated from said second conductor.

12. The electro-thermal gatling gun of claim 11 wherein one of said breechblocks includes:

a first L-shaped conductor for connecting said first conductor to a first lead on said casing of said electro-thermal round when said one of said breechblocks is in said breech position; and a second L-shaped/circular conductor for connecting said second conductor to a second lead on said casing of said electro-thermal round when said one of said breechblocks is in said breech position.

13. An electro-thermal gatling gun for firing an electro-thermal round having a projectile and a casing, comprising:

a plurality of gun barrels;

a gun rotor defining a plurality of channel means each for guiding a breechblock between a rear position and a breech position, each said guide channel means being aligned with and rotatably fixed to one of said plurality of gun barrels;

cam guide means for moving said breechblocks reciprocally and in series from said rear position to said breech position as said gun rotor rotates;

said electro-thermal round being electrically connected to one of said breechblocks when said breechblock is in said breech position;

rotating electrical means for providing an electrical connection between a high power electrical cable and said one of said breechblocks when said one of said breechblocks is in said breech position and for maintaining said electrical connection during gun rotation and until said projectile exits the gun barrel, said rotating electrical means including a stator connected to said high power electrical cable, a rotor contact fixed for rotation with said gun rotor, and brush contact means for electrically connecting said rotor contact and said stator as said rotor rotates wherein said rotor contact connects said stator to said one of said breechblocks in said breech position and wherein said rotor contact, said stator and said brush contacts are insulated from said gun rotor.

14. A method of firing an electro-thermal round from a gatling gun including a plurality of gun barrels and a gun rotor defining a plurality of guide channels, comprising the steps of:

providing a rotating electrical means including a stator, a brush contact, and a rotor contact;

maintaining connection between the stator and the rotor contact with the brush contact as the rotor contact rotates;

slidably mounting a breechblock including an insulated electrical contactor in each guide channel;

moving the plurality of breechblocks reciprocally and in series with a cam means from a rear position to a breech position;

inserting electro-thermal rounds each including a casing and a projectile in front of said breechblocks when said breechblocks are moving from the rear position to the breech position;

electrically connecting the rotor contact with the insulated electrical contactor in one of said plurality of breechblocks when said one of said breechblocks is in the breech position;

applying an electrical pulse to the stator when one of the breechblocks is in the breech position;

maintaining electrical contact between the rotor contact and said one of said breechblocks during gun rotation; and thereafter retracting the breechblock to the rear position to break electrical connection with the rotor contact when the projectile exits the gun barrel.

* * * * *